US006618565B2

(12) United States Patent
Tamiya et al.

(10) Patent No.: US 6,618,565 B2
(45) Date of Patent: Sep. 9, 2003

(54) TRANSFER BIAS APPLYING METHOD FOR AN IMAGE FORMING APPARATUS AND DEVICE FOR THE SAME

(75) Inventors: Takahiro Tamiya, Tokyo (JP); Akihiro Sugino, Numazu (JP); Hiromi Ogiyama, Tokyo (JP); Katsuya Kawagoe, Tokyo (JP); Kohki Katoh, Tokyo (JP); Mitsuru Takahashi, Kawasaki (JP); Yuuji Sawai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/200,178

(22) Filed: Jul. 23, 2002

(65) Prior Publication Data

US 2003/0026625 A1 Feb. 6, 2003

(30) Foreign Application Priority Data

Jul. 23, 2001 (JP) ..... 2001-222344

(51) Int. Cl.[7] ..... G03G 15/16; G03G 15/01

(52) U.S. Cl. ..... 399/66; 399/299

(58) Field of Search ..... 399/66, 88, 89, 399/297, 299, 302, 310; 361/235

(56) References Cited

U.S. PATENT DOCUMENTS

| | | | |
|---|---|---|---|
| 5,483,330 | A | 1/1996 | Ogiyama et al. |
| 5,599,645 | A | 2/1997 | Tamiya et al. |
| 5,740,492 | A | 4/1998 | Deki et al. |
| 5,870,650 | A | 2/1999 | Takahashi et al. |
| 5,890,030 | A | 3/1999 | Namekata et al. |
| 6,021,287 | A | 2/2000 | Tanaka |
| 6,035,157 | A | 3/2000 | Takahashi et al. |
| 6,134,416 | A | 10/2000 | Tamiya |
| 6,163,661 | A | 12/2000 | Namekata et al. |
| 6,184,910 | B1 | 2/2001 | Sasaki et al. |
| 6,212,351 | B1 | 4/2001 | Kawagoe et al. |
| 6,445,900 | B2 | 9/2002 | Fukao et al. |

FOREIGN PATENT DOCUMENTS

| | | | |
|---|---|---|---|
| JP | 2000-137366 | | 5/2000 |
| JP | 2001-175055 A | * | 6/2001 |
| JP | 2001-183889 A | * | 7/2001 |
| JP | 2001-183916 A | * | 7/2001 |

OTHER PUBLICATIONS

U.S. patent application Ser. No. 10/200,178 filed Jul. 23, 2002 by Tamiya et al.
U.S. patent application Ser. No. 10/373,050 filed Feb. 26, 2003 by Yoshikawa et al.

* cited by examiner

*Primary Examiner*—Joan Pendegrass
(74) *Attorney, Agent, or Firm*—Oblon, Spivak, McClelland, Maier & Neustadt, P.C.

(57) ABSTRACT

In an electrophotographic image forming apparatus of the type including a plurality of image carriers arranged along an image transfer belt and an image transferring device configured to transfer toner images of different colors from the image carriers to a sheet being conveyed by an image transfer belt or by way of the image transfer belt by applying a bias to the belt, a bias applying method of the present invention can measure a current leaking between a plurality of high-tension power supply sections or to the ends thereof as AC resistances between respective terminals and therefore to accurately measure the leak currents of DC components. Therefore, when relatively high DC components are selected, a difference in current between a plurality of power supply sections can be maintained constant.

7 Claims, 15 Drawing Sheets

FIG. 14

| AC LEAK CURRENT | AC RESISTANCE (Ω) | DC RESISTANCE (Ω) | DC LEAK CURRENT |
|---|---|---|---|
| 0 | ∞ | ∞ | 0 |
| 10 μA | $10^7$ | $10^8$ | 6 μA |
| 20 μA | $5\times10^6$ | $5\times10^7$ | 10 μA |
| 30 μA | $3\times10^6$ | $3\times10^7$ | 12 μA |
| 50 μA | $2\times10^6$ | $2\times10^7$ | 16 μA |
| 100 μA | $1\times10^6$ | $1\times10^7$ | 30 μA |

FIG. 15

$$\begin{pmatrix} I_{DC}-K \\ I_{DC}-C \\ I_{DC}-M \\ I_{DC}-Y \end{pmatrix} = \begin{pmatrix} I_{DC}-K \\ I_{DC}-C \\ I_{DC}-M \\ I_{DC}-Y \end{pmatrix} + g \begin{pmatrix} \text{AC LEAK} \\ \rightarrow\text{DC} \\ \text{DC LEAK} \end{pmatrix} \left\{ \begin{pmatrix} 0111 \\ 1011 \\ 1101 \\ 1110 \end{pmatrix} \begin{pmatrix} S_1\ \text{AC} \\ S_2\ \text{DC} \\ S_3\ \text{AC} \\ S_4\ \text{AC} \end{pmatrix} + \begin{matrix} So \\ \text{AC} \end{matrix} + \begin{matrix} Ss \\ \text{AC} \end{matrix} \right\}$$

TRANSFER BIAS APPLYING METHOD FOR AN IMAGE FORMING APPARATUS AND DEVICE FOR THE SAME

BACKGROUND OF THE INTENTION

1. Field of the Invention

The present invention relates to a copier, facsimile apparatus, printer or similar electrophotographic image forming apparatus, particularly an image forming apparatus of the type including a plurality of image carriers arranged along an image transfer belt and an image transferring device configured to transfer toner images of different colors from the image carriers to a sheet being conveyed by an image transfer belt or by way of the image transfer belt by applying a bias to the belt. More particularly, the present invention relates to a bias applying method for an image forming apparatus of the type described and a device for the same.

2. Description of the Background Art

Today, a color copier, color printer or similar color image forming apparatus is spreading and includes either a single photoconductive drum or a plurality of photoconductive drums arranged in a tandem configuration. In the color image forming apparatus including a single drum, a plurality of developing units are arranged around the drum, and each forms a toner image on the drum in a particular color. Toner images so formed on the drums are transferred to a sheet one above the other, completing a full-color image. In the tandem color image forming apparatus, the drums or image carriers are arranged along the surface of a transfer belt. Toner images formed on the drums in respective colors are transferred to a sheet, OHP (Over Head Projector) sheet or similar recording medium either directly or indirectly with a bias being applied to the transfer belt.

The color image forming apparatus with a single drum is small size and low cost. However, to form a full-color image, the apparatus has to repeat image formation a plurality of times (usually four times) with the drum, resulting in a long image forming time that obstructs high-speed image formation. By contrast, the tandem image forming apparatus can form a full-color image with a plurality of (usually four) drums and therefore at high speed although it is bulky and high cost.

The tandem color image forming apparatus uses either one of a direct image transfer system and an indirect image transfer system. In the direct image transfer system, intermediate image transferring devices corresponding one-to-one to the drums transfer toner images of different colors from the drums to a sheet being conveyed by a conveying belt one above the other. In the indirect image transfer system, primary image transferring devices transfer toners of different colors from the drums to an intermediate image transfer belt one above the other. Subsequently, a secondary image transferring device transfers the resulting full-color image from the intermediate image transfer belt to a sheet.

A problem with the direct image transfer system is that a sheet feeder and a fixing unit should be respectively positioned upstream and downstream of the plurality of drums arranged along the conveying belt, increasing the size of the apparatus body in the direction of sheet conveyance. By contrast, the indirect image transfer system allows the secondary image transfer devices to be relatively freely laid out, so that the sheet feeder and fixing unit can be arranged one above the other below the drums. This successfully reduces the overall size of the apparatus body.

Another problem with the direct image transfer system is that when the fixing unit is positioned near the most downstream drum in order to reduce the size in the direction of sheet conveyance, a sufficient path for a sheet to bend cannot be provided between the drum and the fixing unit. Consequently, the fixing unit is apt to adversely influence image formation effected at the upstream side due to an impact ascribable to the leading edge of a sheet entering the fixing unit or a difference between the speed of the sheet passing the fixing unit and the speed of the conveying belt. The indirect image transfer system guarantees a sufficient path for a sheet to bent and is therefore free from such a problem.

As for a modern color image forming apparatus, there is an increasing demand for full-color image formation as rapid as monochromatic image formation. In this respect, the tandem color image forming apparatus, particularly one using the indirect image transfer system, is attracting increasing attention.

It has been reported in relation to the tandem, indirect image transfer type color image forming apparatus that image degradation ascribable to, e.g., the scattering of toner can be improved if the intermediate image transfer belt has an outer surface layer provided with high resistance. However, when the intermediate image transfer belt has a single layer with high resistance, it is difficult to set a position where an adequate bias for primary image transfer should be applied to the belt for the transfer of a toner image from the drum to the belt. Even a shift of the above position by several millimeters results in defective image transfer. More specifically, the bias for primary image transfer is intended to form an electric field in a gap between the drum and the intermediate image transfer belt for thereby transferring a toner image from the drum to the intermediate image transfer belt. Should the electric field not lie in an adequate range, a toner image transferred to the intermediate image transfer belt would be irregular.

In light of the above, the inner surface or reverse surface of the intermediate image transfer belt to which the bias is to be applied may be provided with medium resistance. Medium resistance equalizes potentials around the portion of the intermediate image transfer belt to which the bias is applied, thereby broadening the range of the adequate position where the bias should be applied.

However, the intermediate image transfer belt with the inner surface having medium resistance has a problem that the bias applied to the expected portion of the belt for primary image transfer leaks. Further, the inner surface layer of the intermediate image transfer belt is generally formed of a material with carbon black or similar conduction agent dispersed therein or an ion-conductive material. However, the material with a conductive agent dispersed therein has a disadvantage in that the dispersion of the agent is irregular due to production reasons. The ion-conductive material has a disadvantage that resistance thereof is apt to vary due to, e.g., the varying environment, e.g., temperature and humidity. It is therefore necessary to adequately control the bias to be applied to the intermediate image transfer belt.

Some different schemes customarily used to control the bias for the intermediate image transfer belt will be described hereinafter. A first scheme is constant voltage control. When a constant voltage bias is applied to the intermediate image transfer belt, the leak of a current mentioned above does not occur. However, when the charge potential or the resistance of the high-resistance layer forming the outer surface of the belt is irregular, the constant voltage control cannot maintain a current to flow toward the drum constant. More specifically, as for the charging of the high-resistance layer, the potential condition is necessarily effected by history and therefore results in the aggravation of noise.

A second scheme is providing the medium resistance layer on the inner surface of the intermediate image transfer belt with relatively high resistance close to the upper limit to thereby reduce the mutual influence of the primary image transfer positions as far as possible. However, the prerequisite with this scheme is that the resistances of the materials constituting the belt be strictly standardized, resulting in low yield and high cost.

A third scheme uses a differential constant current. This scheme measures a leak current leaking around the intermediate image transfer belt and adding the leak current to the bias beforehand to thereby indirectly maintain the current to flow toward the drum constant. The differential constant current scheme is customary with a belt transfer type monochromatic machine or an intermediate image transferring device included in a revolver type (non-tandem type) machine.

The third scheme, however, cannot be applied to the tandem, intermediate image transfer type image forming apparatus for the following reason. In this type of image forming apparatus, currents to flow at nearby primary image transfer positions noticeably influence each other. Moreover, which power source output should be controlled is not known. More specifically, such an image forming apparatus includes, e.g., four power supplies each for applying a bias to bias applying means located at a particular image transfer position. Therefore, even when a leak current is sensed at both ends of the intermediate image transfer belt, a portion where the current is leaking cannot be located.

As for the tandem, intermediate image transfer type image forming apparatus, there has been proposed a method that directly connects an ammeter between nearby bias applying means in order to measure their relation. For example, an ammeter using an optical fiber output is positioned between nearby high voltages so as to perform calculation with the output of the ammeter. This kind of configuration is available on the market as a current metering unit highly resistive to noise for use in factories. However, a plurality of such current metering units installed in the image forming apparatus would result in a prohibitive cost.

Technologies relating to the present invention are disclosed in, e.g., Japanese Patent Laid-Open Publication No. 2000-137366.

SUMMARY OF THE INVENTION

It is an object of the present invention to provide a bias applying method capable of accurately estimating the DC leak current of a bias applied to an image transfer belt to thereby maintain a differential current between a plurality of power supplies constant, a device for the same, and an image forming apparatus including the device. A bias applying method of the present invention is applicable to a bias applying device configured to form, at each of image transfer positions where a plurality of image carriers and an image transfer belt moving in contact with the surfaces of the image carriers, an electric field for transferring a toner image formed on each image carrier to a transfer medium by applying a bias to the image transfer belt. The bias applying device includes a plurality of bias applying means each for applying a bias to the image transfer belt at the respective image transfer position. A plurality of high-potential power supply sections each are connected to one of the bias applying means for applying a bias, which consists of a DC component and a particular AC component superposed on the DC component, to the respective bias applying means. A plurality of sensing sections each are connected one of the bias applying means for sensing the AC component of the bias of the respective bias applying means. A central processing unit controls the high-tension power supply sections and sensing sections. The bias applying method detects the AC component of a second high-tension power supply section, which is detected at the output of a first high-tension power supply section, determines an AC resistance between the first and second high-tension power supply sections on the basis of the absolute value of the AC component detected, estimates the leak current of a DC component by referencing a table listing a correlation between AC resistances and DC resistances and prepared beforehand, and adds the leak current to a set DC value assigned to the first high-tension power supply section to thereby correct the bias.

A bias applying device for practicing the above method and an image forming apparatus including the same are also disclosed.

BRIEF DESCRIPTION OF THE DRAWINGS

The above and other objects, features and advantages of the present invention will become more apparent from the following detailed description taken with the accompanying drawings in which:

FIG. 14 is a table listing a correlation between AC resistance, DC resistance, AC leak current, and DC leak current;

FIG. 15 shows an equation for producing a current value to be assigned to each high-tension power supply;

DESCRIPTION OF THE PREFERRED EMBODIMENTS

Figure 1:
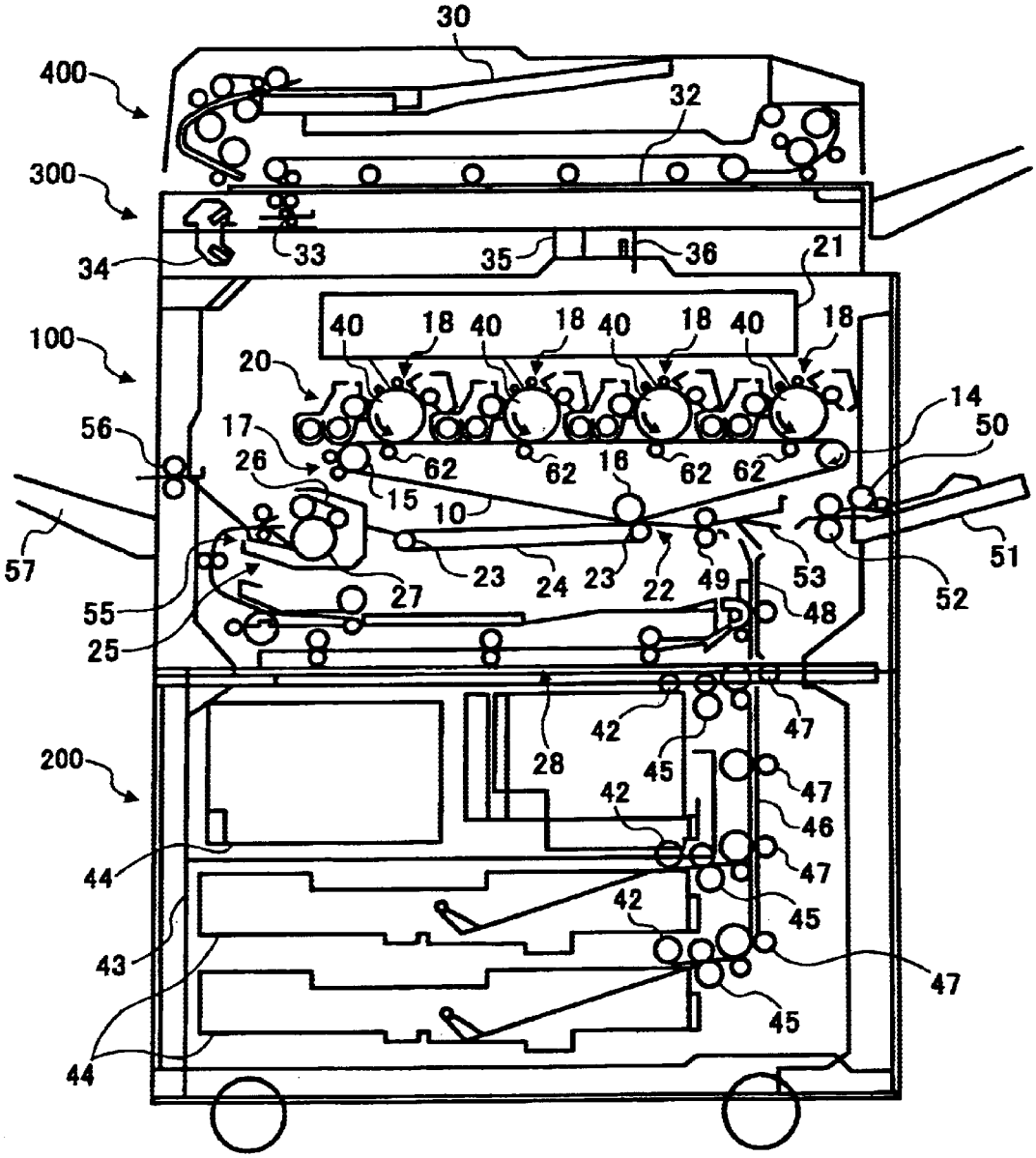
FIG. 1 shows an image forming apparatus embodying the present invention and implemented as a copier by way of example.

Referring to FIG. 1 of the drawings, an image forming apparatus to which the present invention is applied is shown and implemented as a tandem color copier by way of example. As shown, the color copier is generally made up of a copier body 100, a sheet feed table 200 on which the copier body 100 is mounted, a scanner 300 mounted on the copier body 100, and an ADF (Automatic Document Feeder) 400 mounted on the scanner 300.

Figure 2:
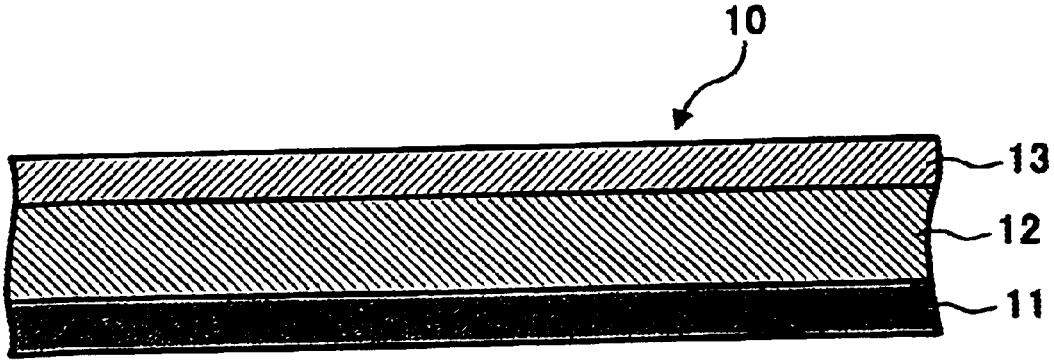
FIG. 2 is a fragmentary section showing an intermediate image transfer belt included in the illustrative embodiment.

The copier body 100 includes an endless, intermediate image transfer belt (simply intermediate belt hereinafter) 10, which is a specific form of an intermediate image transfer body. As shown in FIG. 2, the intermediate belt 10 is made up of a base layer 11, an elastic layer 12 and a coat layer 13 sequentially stacked in this order from the bottom to the top. The base layer 10 is formed of, e.g., fluorocarbon resin having low stretchability or rubber having high stretchability and canvas covering such a material. The elastic layer 12 is formed of, e.g., fluorine-contained rubber or acrylonitrile-butadien copolymer rubber. The coat layer is implemented by, e.g., fluorine-contained rubber and provided with high smoothness.

As shown in FIG. 1, the intermediate belt 10 is passed over a plurality of rollers, i.e., three rollers 14, 15 and 16 in the illustrative embodiment and movable in a direction indicated by arrow. A belt cleaner 17 is positioned at the left-hand side of the roller 15, as viewed in FIG. 1, in order to clean the surface of the intermediate belt 10 after image transfer. Black, yellow, magenta and cyan image forming means 18 are arranged side by side above part of the belt 10 extending between the rollers 14 and 15 in the direction of movement of the intermediate belt 10, constituting a tandem image forming device 20. In the illustrative embodiment, assuming that yellow, magenta and cyan color image formation is canceled in a black (Bk) mode, then development is effected in the order of cyan, magenta, yellow, and black.

An optical writing device 21 is positioned above the image forming device 20. A secondary image transferring device 22 is positioned at the opposite side to the intermediate belt 10 with respect to the image forming device 20 and includes an endless, secondary image transfer belt (simply secondary belt hereinafter) 24 passed over rollers 23. The secondary belt 24 is pressed against the roller 16 via the intermediate belt 10, so that a toner image can be transferred from the intermediate belt 10 to a sheet or recording medium.

A fixing device 25 is positioned downstream of the secondary image transferring device 22 for fixing the toner image on the sheet. The fixing device 25 includes an endless, fixing belt 26 and a press roller pressed against the fixing belt 26.

The secondary image transferring device 22 serves to convey the sheet to the fixing device 25 at the same time. Of course, the secondary image transferring device 22 may be implemented as a transfer roller or a non-contact type charger.

A sheet turning device 28 is arranged below the secondary image transferring device 22 and fixing device 25 in parallel to the image forming device 20. The sheet turning device 28 is used to form images on both sides of a sheet in a duplex copy mode.

In operation, the operator stacks desired documents on a document tray 30 included in the ADF 40 or opens the ADF 40 upward, sets a document on a glass platen 32 included in the scanner 300, and then closes the ADF 400 downward to press the document. Subsequently, the operator presses a start switch not shown. In response, in the former case, the scanner 300 is driven after one document has been conveyed by the ADF 400 to the glass platen 32. In the latter case, the scanner 300 is driven immediately after the document has been set on the glass platen. In any case, a first carriage 33 and a second carriage 34 included in the scanner 300 move with a light source mounted on the first carriage 33 illuminating the document. The resulting reflection from the document is incident to a mirror mounted on the second carriage 34. The mirror reflects the incident light toward an image sensor 36 via a lens 35, so that the image sensor 36 reads the document image represented by the light.

When the start switch is pressed, a drive motor, not shown, causes one of the rollers 14 through 16 to rotate and thereby causes the intermediate belt 10 to move; the other rollers are rotated by the belt 10. At the same time, in each of the four image forming means 18, a photoconductive drum or image carrier 40 is rotated to form a toner image with particular one of black toner, yellow toner, magenta toner, and cyan toner. Such toner images are sequentially transferred from the drums 40 to the intermediate belt 10 one above the other, completing a full-color image on the belt 10.

Further, when the start switch is pressed, one of pickup rollers 42 included in the sheet feed table 200 is driven to pay out a sheet from associated one of sheet cassettes 44, which are arranged one above the other in a paper bank 43. At this instant, a reverse roller 45 cooperates with the pickup roller 42 to separate the above sheet from the other sheets. The sheet paid out is introduced into a sheet path 46. Rollers 47 arranged on the sheet path convey the sheet toward a registration roller 49 via a sheet path 48 arranged in the copier body 100. When the operator feeds sheets via a manual feed tray 51 by hand, a pickup roller 50 associated with the manual feed tray 51 is rotated to pay out one sheet toward a sheet path 53 in cooperation with a reverse roller 52. The sheet path 53 also extends toward the registration roller 49.

The registration roller 49 once stops the sheet conveyed thereto and then drives it in synchronism with the full-color image transferred to the intermediate belt 10. When the sheet arrives at a nip between the intermediate belt 10 and the secondary image transferring device 22, the device 22 transfers the full-color image from the intermediate belt 10 to the sheet. The secondary image transferring device 22 conveys the sheet carrying the image thereon to the fixing device 25. The fixing device 25 fixes the image on the sheet with heat and pressure to thereby fix the former on the latter. A path selector 55 steers the sheet with the fixed image, i.e., a copy to a copy tray 57 via an outlet roller 56. In a duplex copy mode, the path selector 55 is switched to steer the above sheet into the sheet turning device 28. The sheet turning device 28 turns the sheet and again feeds it to the nip between the intermediate belt 10 and the secondary image transferring device 22. As a result, another full-color image is formed on the other side of the same sheet. The resulting duplex copy is driven out to the copy tray 57 via the outlet roller 56.

After the image transfer, the belt cleaner 17 removes the toner left on the intermediate belt 10 to thereby prepare the belt for the next image forming cycle.

While the registration roller 49 is, in many cases, connected to ground, a bias may be applied to the registration roller 49 in order to remove paper dust. For this purpose, the registration roller 49 may have a diameter of 18 mm and covered with conductive rubber, e.g., 1 mm thick conductive NBR (nitrile rubber). This kind of registration roller 49 has a volume resistivity of $10^9$ Ω·cm. A voltage of about −800 V is applied to the surface of the registration roller 49. A voltage of about +200 V is applied to the reverse side of the sheet. Generally, in the intermediate image transfer system, paper dust cannot easily move to the drums, so that the transfer of paper dust does not have to be taken into account. This is why the registration roller 49 is usually connected to ground. While the voltage is generally implemented as a DC bias, it may alternatively be implemented as an AC voltage containing a DC offset component.

The sheet moved away from the biased registration roller 49 has its front side slightly charged to the negative side. Consequently, as for secondary image transfer from the belt 10 to the sheet, image transfer conditions are sometimes varied, compared to the case wherein the bias is not applied to the registration roller 49.

Figure 3:
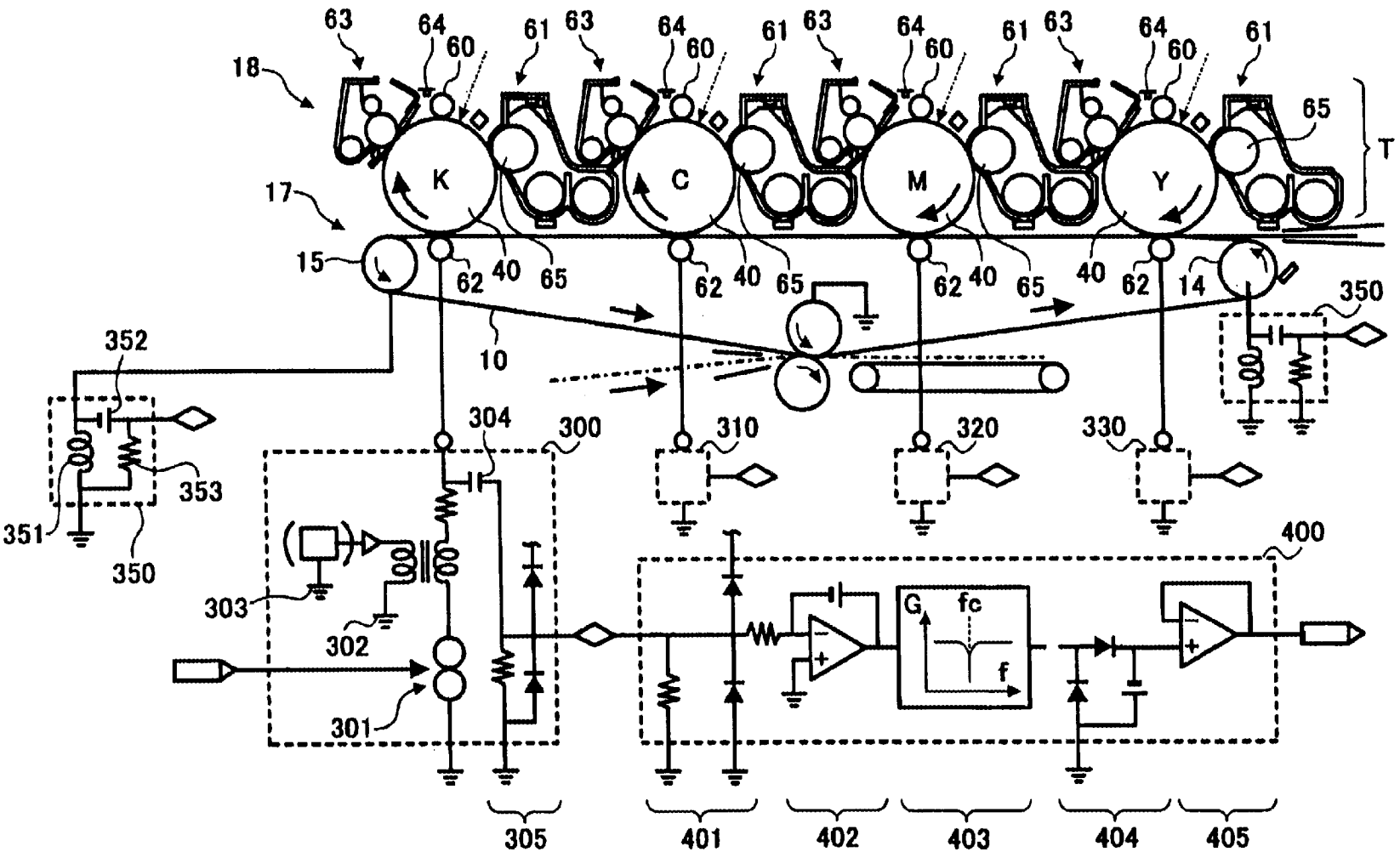
FIG. 3 shows a bias applying device included in the illustrative embodiment.

As shown in FIG. 3, each image forming means 18 includes a charger 60, a developing device 61, a primary image transferring device 62, a drum cleaning device 63 and a discharger 64 arranged around the drum 40. The intermediate belt 10 has customarily been formed of fluorine-contained resin, polycarbonate resin, polyimide resin or similar resin. Today, however, an elastic, intermediate image transfer belt entirely or partly formed of an elastic material is replacing the above conventional belt. The transfer of a color image using the resin belt has the following problems.

A full-color image is usually formed by toner of four different colors in the form of a first layer to a fourth layer. The first to fourth layers are subjected to pressure when being conveyed via the primary image transfer positions (from the drums to the intermediate belt 10) and secondary image transfer position (from the intermediate belt 10 to the sheet). As a result, grains constituting the first to fourth layers cohere together and cause the center portion of a character to be lost or cause the edges of a solid image to be lost.

The resin belt, which is hard and does not deform complementarily to the toner layers, is apt to compress the layers and thereby bring about the omission of the center portion of a character. Today, there is an increasing demand for an implementation for forming full-color images on various kinds of sheets, e.g., sheets of Japanese paper and intentionally undulated sheets. Such a sheet, however, is likely to cause gaps to appear between the toner image and the sheet surface, resulting in the local omission of the toner image. Should the transfer pressure at the secondary image transfer position be raised to enhance adhesion between the toner and the sheet, the cohesion of the toner layers would be aggravated and would thereby bring about the omission of the center portion of a character.

By contrast, an elastic belt lower in hardness than the resin belt can deform complementarily to even a sheet having a rough surface. The elastic belt therefore does not exert excessive pressure on the toner layers at the secondary image transfer and insures desirable adhesion between the toner and the sheet, thereby freeing even a sheet with a rough surface from the omission of the center portion of a character.

As for the resin of the elastic belt, use may be made of one or more of polycarbonate, fluorine-contained resin (e.g. ETFE or PVDF), polystyrene, chloropolystyrene, poly-α-methylstyrene, styrene-butadien copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyl acrylate copolymer or styrene-phenyl acrylate copolymer), styrene-methacrylate copolymer (e.g. styrene-methyl methacrylate copolymer, styrene-ethyl methacrylate copolymer or styrene-phenyl methacrylate copolymer), styrene-α-methyl chloroacrylate copolymer, styrene-acrylonitrile-acrylate copolymer or similar styrene resin (monomer or polymer containing a styrene substitute product or a styrene substitute product), methyl methacrylate resin, butyl methacrylate resin, ethyl methacrylate resin, butyl acrylate resin, modified acrylic resin (e.g. silicone-modified acrylic resin, vinyl chloride resin-modulated acrylic resin or acrylic urethane resin), vinyl chloride resin, styrene-vinyl acrylate copolymer, vinyl chloride-vinyl acrylate copolymer, rosin-modulated maleic acid resin, phenol resin, epoxy resin, polyester resin, polyester polyurethane resin, polyethylene, polypropylene, polybudadien, polyvinylidene chloride, ionomer resin, polyurethane resin, silicone resin, ketone resin, ehtylene-ethylacrylate copolymer, xylen resin, polyvinyl butyral resin, polyamide resin, and modified polyphenylene oxide resin.

The elastic rubber or elastomer applicable to the elastic belt may be implemented by one or more of butyl rubber, fluorine-contained rubber, acrylic rubber, EPDM, NBR, acrylonitrile-butadiene-styren natural rubber, isoprene rubber, styrene-butadiene rubber, butadien rubber, ethylene-propylene rubber, chloroprene rubber, chlorosulphonated polyethylene, chlorinated polyethylene, urethane rubber, syndiotactic 1,2-polybutadiene, epichlorohydrine rubber, silicone rubber, fluororubber, polysulfide rubber, hydrated nitrile rubber, thermoplastic elastomer (e.g. polystyrene, polyolefine, polyvinyl chloride, polyurethane, polyamide, polyurea, polyester or fluorocarbon resin.

Figure 4:
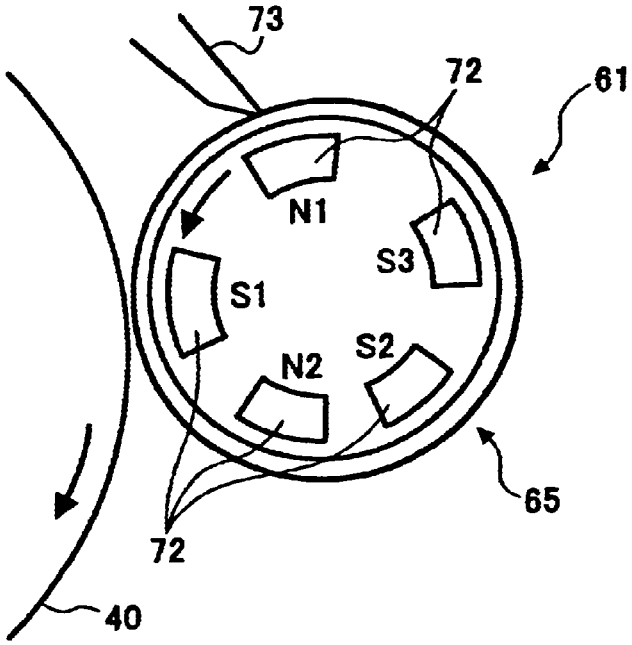
FIG. 4 shows a specific configuration of a developing device included in the illustrative embodiment.

As shown in FIG. 4 specifically, the developing device 61 includes a rotatable, nonmagnetic sleeve 65 and a plurality of magnets 72 fixedly arranged inside the sleeve 65. The magnets 72 each exert a magnetic force on a developer when the developer is brought to a particular position. In the illustrative embodiment, the sleeve 65 has a diameter of 18 mm and its surface roughened to surface roughness Rz of 10 μm to 30 μm by sand blasting or by being formed with grooves that are 1 mm to several millimeters deep.

The magnets 72 respectively have magnetic poles N1, S1, N2, S2 and S3 by way of example, as named from the position where a doctor blade 73 in the direction of rotation of the sleeve 65. The magnets 72 cause a developer deposited on the sleeve 65 to form a magnet brush. The sleeve 65 faces the drum 40 at a position where the pole S1 is positioned.

Figure 5:
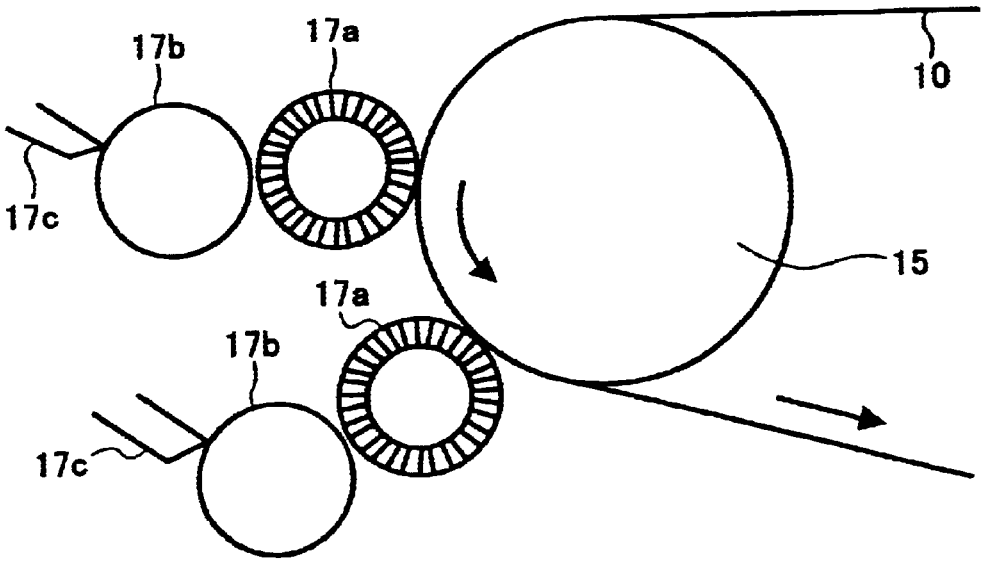
FIG. 5 shows a specific configuration of a belt cleaner included in the illustrative embodiment.

As shown in FIG. 5, the belt cleaner 17 includes two fur brushes 17*a* held in contact with the intermediate belt 10 and rotatable in a direction counter to the belt 10. The fur brushes 17*a* each are provided with a diameter of 20 mm and formed of acrylic carbon of 6.25 D/F, 100,000 filaments per square inch, and E+7 Ω. Power supplies, not shown, each apply a bias of particular polarity to associated one of the fur brushes 17*a*. Metal rollers 17*a* each are held in contact with one of the fur brushes 17*a* and rotates in the same direction as or the opposite direction to the fur brush 17*a*.

In the illustrative embodiment, a negative voltage is applied to one metal roller 17*b* positioned at the upstream side in the direction of rotation of the intermediate belt 10 while a positive voltage is applied to the other roller 17*b* positioned at the downstream side in the same direction. Blades 17*c* each are held in contact with one of the metal rollers 17*b*. While the intermediate belt 10 is rotated in the direction indicated by an arrow in FIG. 5, the upstream fur brush 17*a* applies, e.g., a negative bias to the belt 10 for cleaning the surface of the belt 10. Assuming that −700 V, for example, is applied to the metal roller 17*b*, then the fur brush 17*a* is charged to −400 V with the result that positively charged toner is transferred from the intermediate belt 10 to the fur brush 17*a*. The toner collected by the fur brush 17*a* is then transferred to the metal roller 17*b* due to the potential difference. The blade 17*c* scrapes off the toner from the metal roller 17*b*.

Much toner is left on the intermediate belt 10 even after the upstream fur brush 17*a* has cleaned the intermediate belt 10. However, the toner still left on the intermediate belt 10 is charge to negative polarity by the negative bias applied to the fur brush 17*a*. This is presumably based on charge injection or discharge. Subsequently, the downstream brush 17*a* applied with the positive bias removes the toner left on the belt 10. The toner collected by the downstream brush 17*a* is transferred to the metal roller 17*b* due to the potential difference, scraped off by the blade 17*c*, and then collected in a tank not shown.

Although the downstream fur brush 17*c* removes most toner from the belt 10, some toner is still left on the belt 10, but has been charged to the positive polarity. The positively charged toner is transferred to the drum 40 at the primary image transfer position due to an electric field for image transfer. Such toner is then collected by the drum cleaning device 63, particularly at the first primary image transfer position.

Referring again to FIG. 3, a bias applying device unique to the illustrative embodiment will be described in detail. As shown, the bias applying device is generally made up of high-tension power supply sections 300, 310, 320 and 330, end roller sections 350 and sensing sections 400 each being implemented as a module. The high-tension power supply sections 300 through 330 each are assigned to one of the four image forming sections 18.

The high-tension power supply sections 300 through 330 each include a DC constant portion 301, an AC superposing portion 302, an AC input stage 303, a coupling capacitor 304, and an output stage 305. The DC constant-current portion 301 is a current source whose set value can be controlled from the outside by power module PWM (Pulse Width Modulation); today, a controller is, in many cases, implemented by a margin available with a central control unit. The AC superposing section 302 is a constant-voltage AC control section. As for the AC superposing section 302, a control section for maintaining amplitude constant is not shown while the superposing function is implemented by a transformer; particularly, when a DC current is small, a resistor and capacitor scheme is desirable.

The AC input stage 303 has an exclusive oscillator and allows a frequency to be determined before it is built in the copier body. If desired, the oscillator may be replaced with PWM input from the outside although not shown specifically. A particular frequency is assigned to each color and corresponds to a filter, which will be described later. While the illustrative embodiment uses a frequency for the identification of the power supply, use may alternatively be made of a duty or a phase difference. The coupling capacitor 304, which withstands a high voltage, outputs only an AC component by cutting a DC component. The output stage 305 is constituted by a resistor load with a clamp.

As for the output of each of the high-tension power supply sections 300 through 330, a constant AC voltage with a constant frequency is superposed on a constant DC current source that can be controlled by a program. The AC component may be a sinusoidal wave. In FIG. 1, the colors are assumed to be black (K), cyan (C), magenta (M) and yellow (Y) from the left to the right, but such an order is only illustrative. The output of each high-tension power supply section is connected to the associated sensing section 400 via a capacitor and a suitable voltage divider. The voltage acting on the above load is cut by a suitable band-pass filter or a differentiator by the AC component having the original frequency while the rest of the voltage is converted to a DC component and sent to a central control unit.

The two end roller sections 350 are connected to the rollers 14 and 15, respectively. While the end roller sections 350 are shown in FIG. 3 as being separate from each other, they may be superposed on each other. Each end roller section 350 includes a coil 351, a coupling capacitor 352, and an output stage 353. The coil 351 is substituted for a resistor for sensing an AC current component. However, the coil 351 may be replaced with the resistor if it does not have to be connected to ground with respect to DC. The coupling capacitor 352 is identical with the coupling capacitor 304 of each of the high-tension power supply sections 300 through 330. The output stage 353 is implemented by a resistor load that is not clamped. This is because a high potential does not appear if the intermediate belt 10 has an inner surface layer having medium resistance.

The sensing sections 400 each are assigned to one of the four high-tension power supply sections 300 through 330 and two end roller sections 350. Each sensing section 400 includes an input stage 401 with a clamp, a low-pass filter 402, a notch filter 403, a detector 404, and a buffer 405. When use is made of a single power source type operational amplifier, not shown, an offset voltage may be applied to the input stage 401 via, e.g., a resistor. The low-pass filter 402 cuts unnecessary high-frequency components. Although the constant of the operational amplifier is not shown specifically, the operational amplifier is provided with a cutoff frequency slightly higher than the superposed frequency of the high-tension power supply sections 300 through 330.

Figure 6:
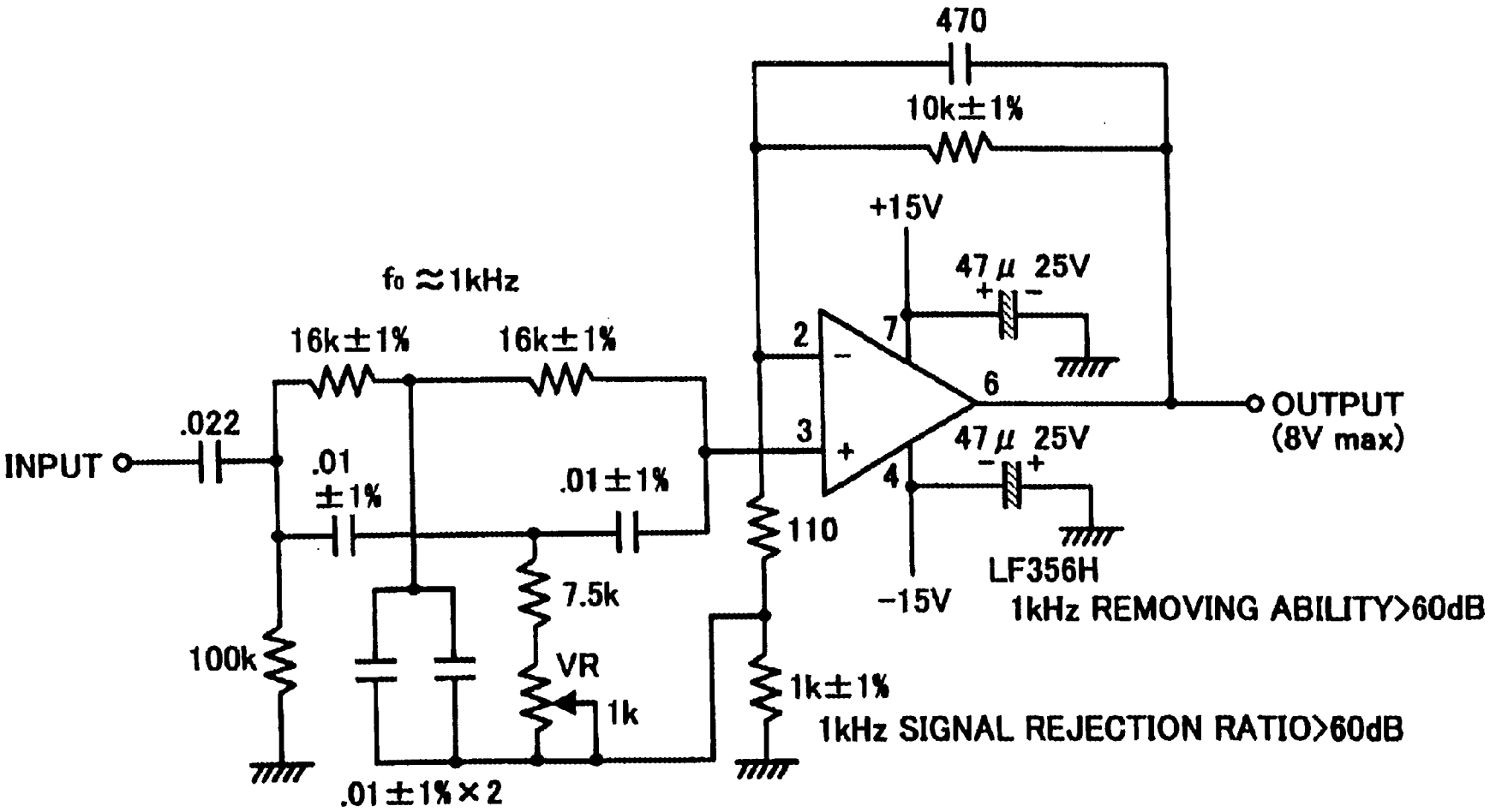
FIG. 6 is a circuit diagram showing an elimination filter used as a notch filter included in the illustrative embodiment.
Figure 7:
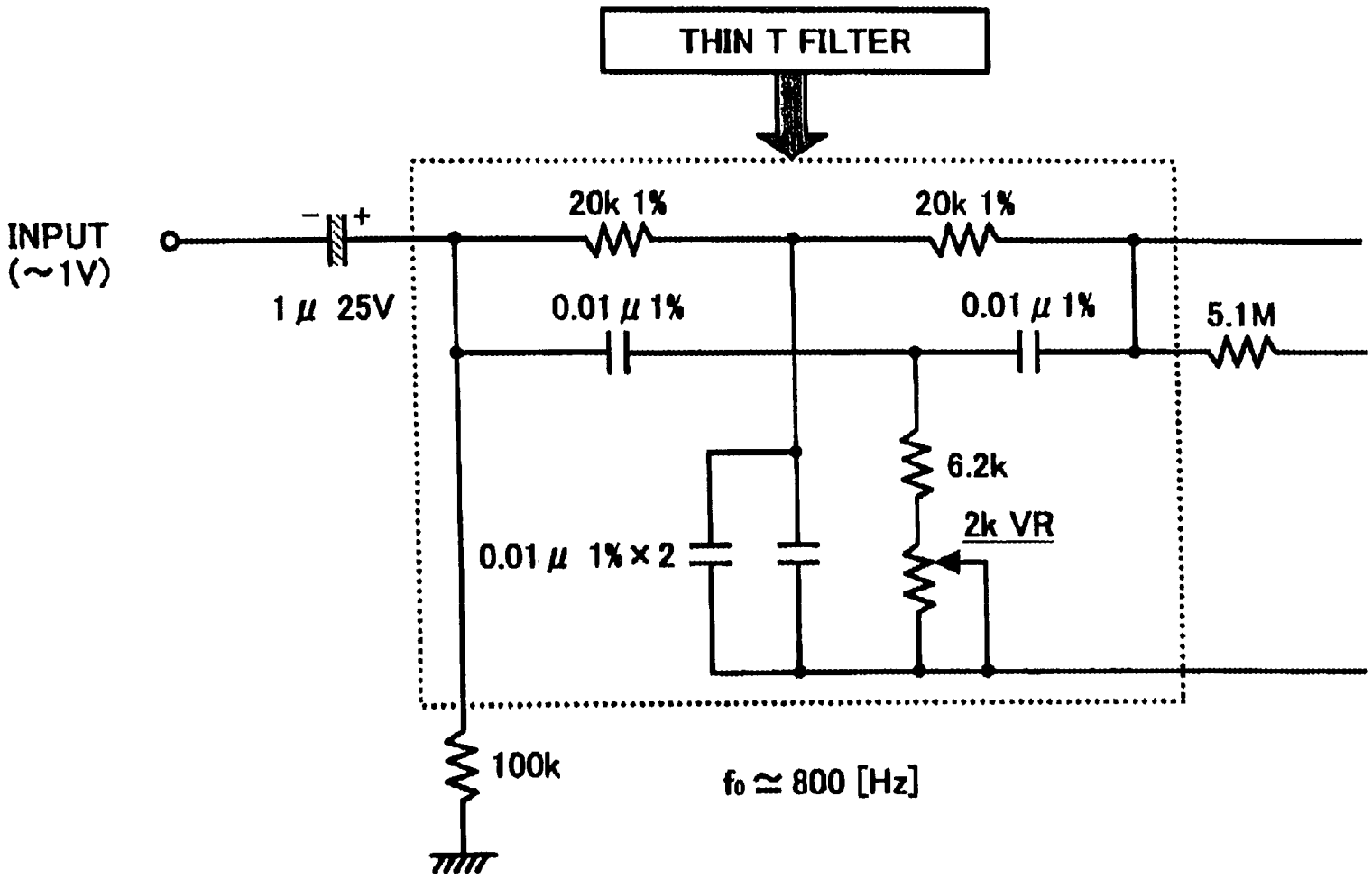
FIG. 7 is a circuit diagram showing another specific configuration of the notch filter.
Figure 8:
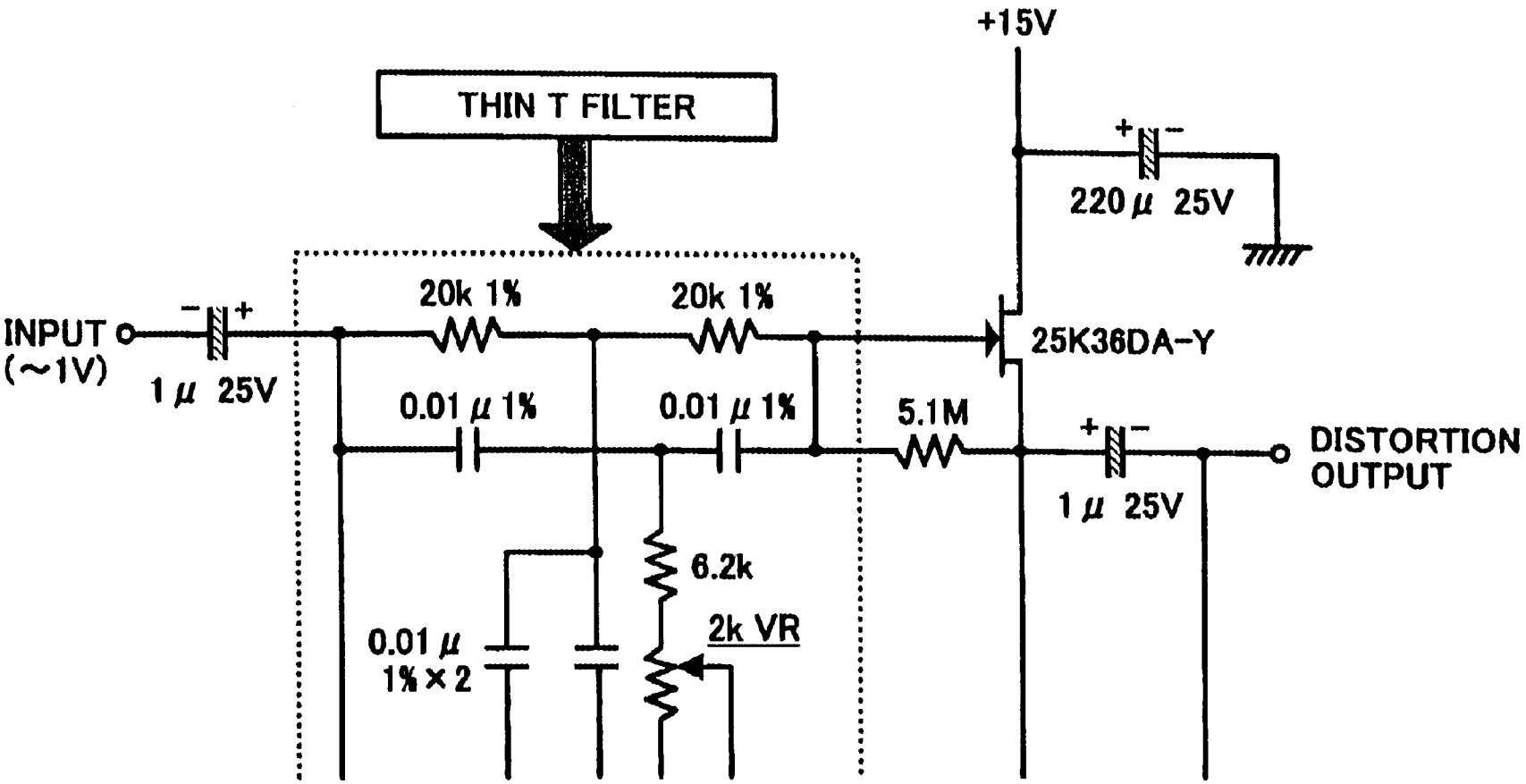
FIG. 8 is a circuit diagram showing still another specific configuration of the notch filter.

The notch filter 403 is a band elimination filter or a rejection filter having a configuration shown in any one of FIGS. 6 through 8 specifically. The notch frequency of the notch filter 403 is matched to the frequency of the high-tension power supply section, so that the notch filter 403 can cut an AC component thereof so as to sense an input current. Such a configuration is well known in the art and will not be described specifically.

The detector 404 converts the input AC component to a DC component. In the illustrative embodiment, the detector 404 is implemented by a Schottky diode for noise cancellation and protection. The buffer, or output stage, 405 may play the role of a voltage shifter, if desired. When a band elimination filter is used as the notch filter 403, it is possible to obtain signals from the entire frequency band at the same time. For more accurate control, it is necessary to use a band-pass filter having a variable frequency in order to pickup the outputs of the other power supplies one by one. In the illustrative embodiment, an elimination filter is used because such accuracy is not necessary and because an elimination filter saves time.

Figure 9:
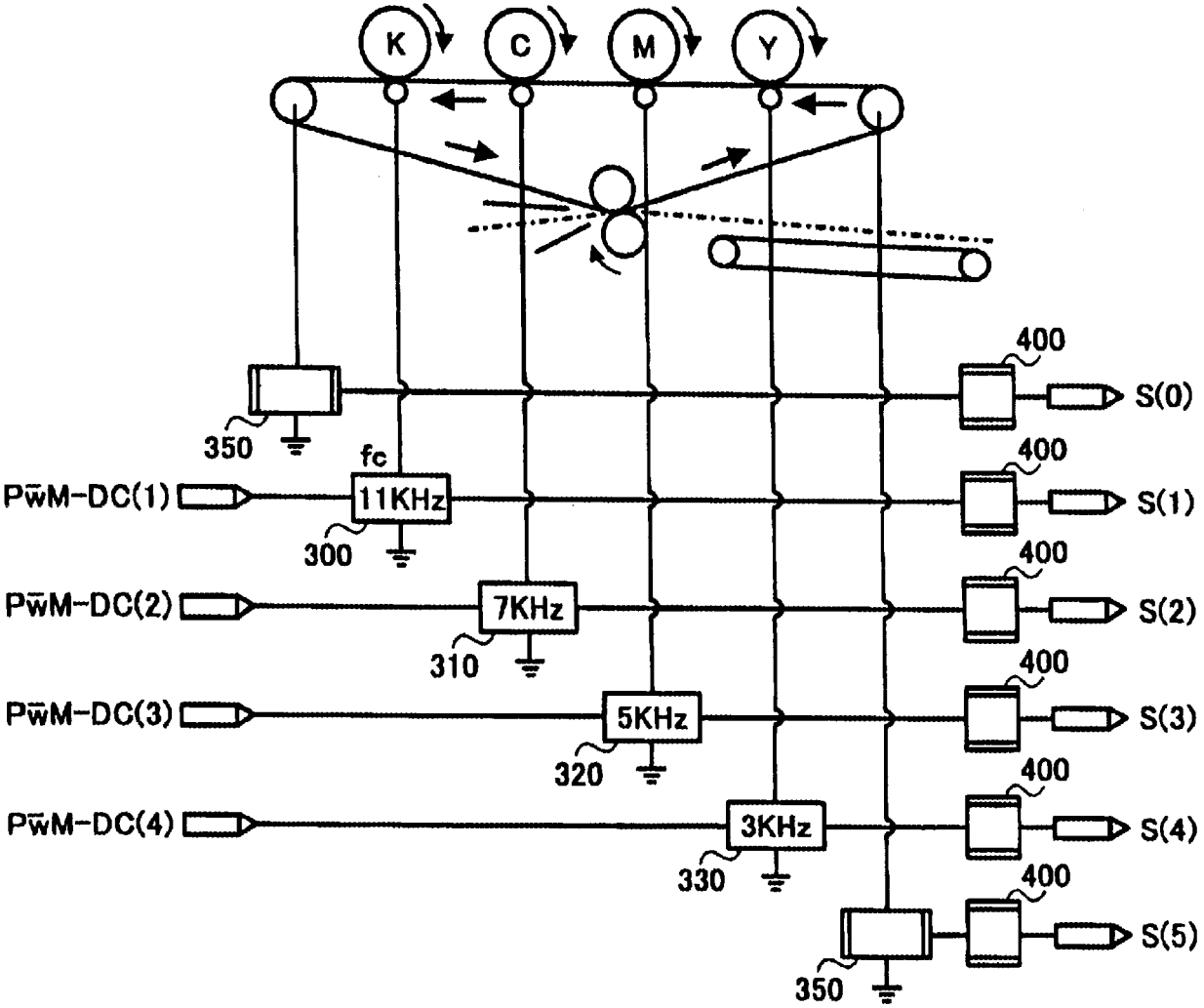
FIG. 9 demonstrates the operation of the bias applying device of the illustrative embodiment.

Reference will be made to FIG. 9 for describing the operation of the bias applying device. The maximum amplitude of each high-tension power supply section is selected to be about 100 V, which provides the sense terminal with a sufficient S/N (Signal-to-Noise) ratio. The maximum amplitude should preferably be a low constant voltage. This is also true when consideration is given to stability. Superposed frequencies of 11 kHz, 7 kHz, 5 kHz and 3 kHz are assigned to the high-tension power supply sections 300 through 330, respectively. The high frequency assigned to black (K), which is more conspicuous than the other colors, obviates moiré when a high-definition output is required. When the linear velocity is about 400 mm/sec, the frequency of 3 kHz is likely to bring about jitter of about 0.1 mm, but such jitter is not conspicuous to eyes. Further, such a frequency range allows a general-purpose operational amplifier to be used and therefore reduces the cost. The above frequencies are prime to each other, i.e., each is the product of a particular prime number and the power of 10. Such a prime relation allows the frequencies to be separated when mixed together. Alternatively, to avoid usual 50 Hz or 60 Hz power supply noise, use may be made of multiples of such a frequency.

Figure 10:
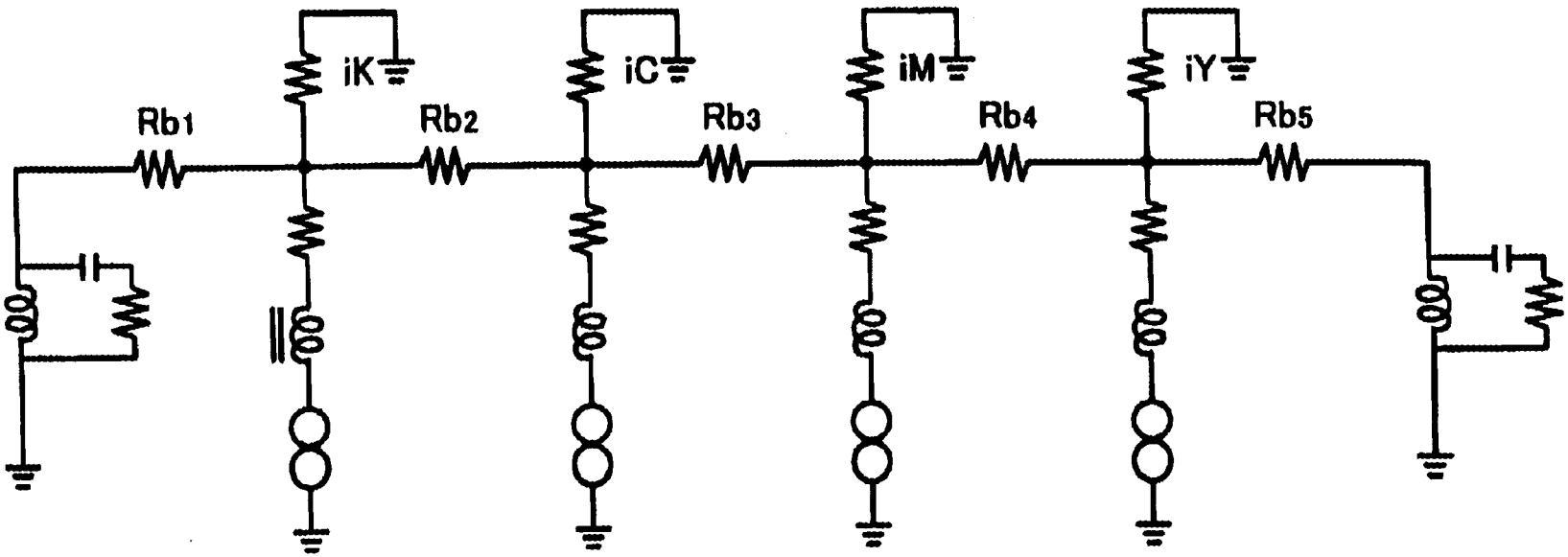
FIG. 10 is a circuit diagram showing a DC model of the bias applying device.
Figure 11:
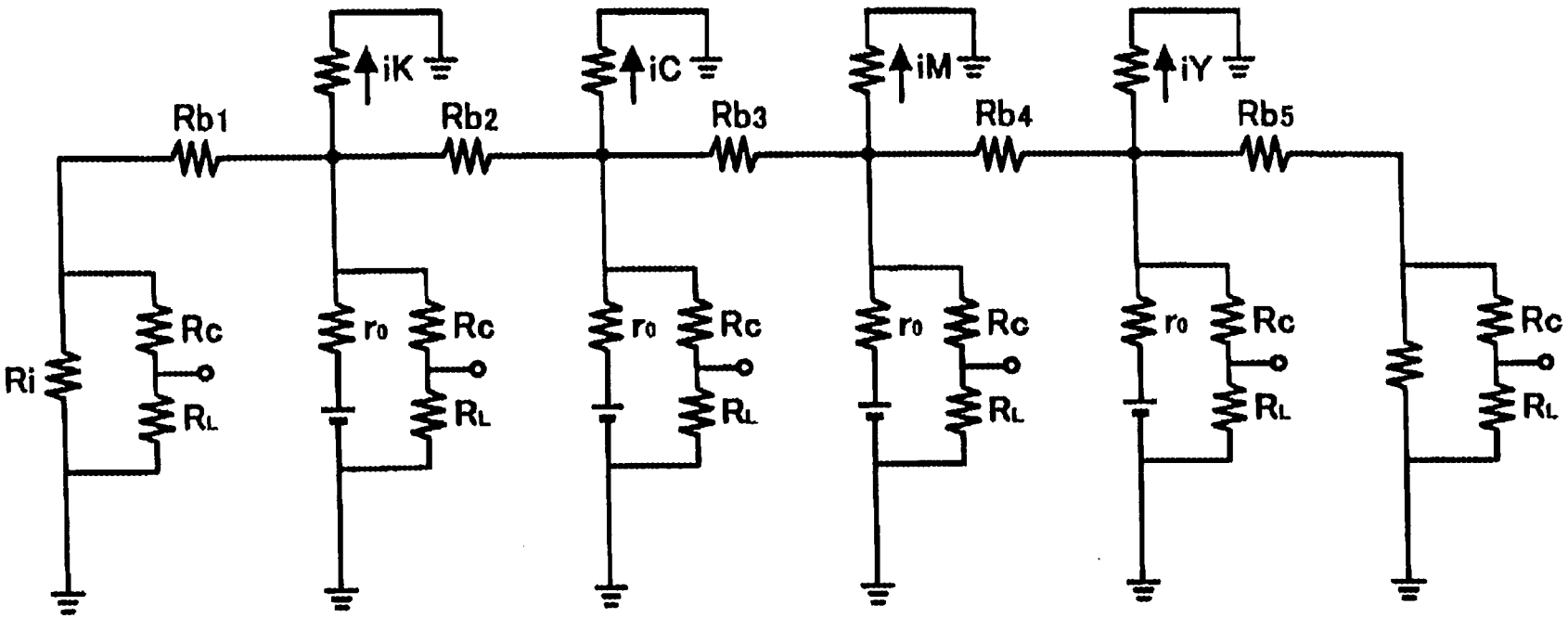
FIG. 11 is a circuit diagram showing an AC model of the bias applying device.

FIGS. 10 and 11 respectively show the DC model and AC model of the circuitry shown in FIG. 9. In the AC model, capacity and reactance are replaced with resistors while a high DC voltage component is cut. In FIGS. 10 and 11, there are shown an inductance Ri, coupling capacitors Rc, AC loads RL, internal resistances ro of the constant current sources, resistances Rb of the inner surface of the intermediate belt, and a power supply E. Currents iK, iC, iM and iY are the currents i to be controlled.

Figure 12:
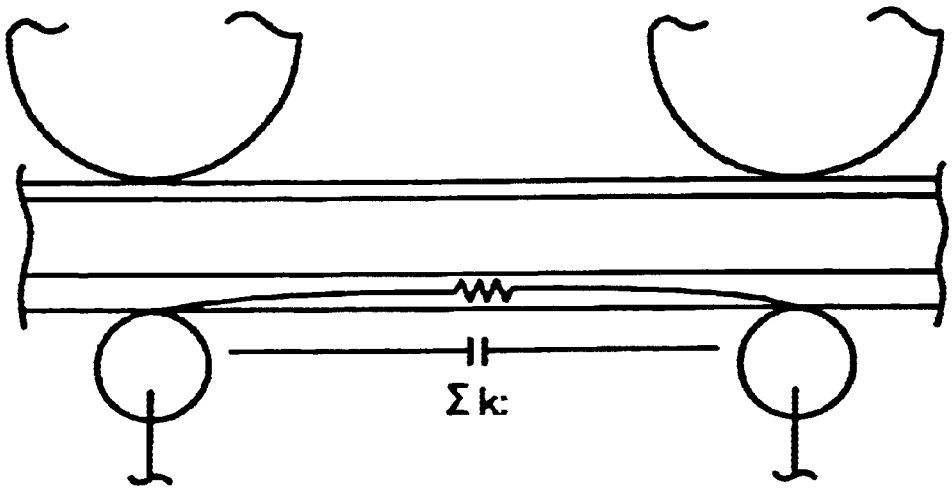
FIG. 12 is a view for describing a current to flow through the inner surface of an intermediate image transfer belt included in the illustrative embodiment and derived from DC.
Figure 13:
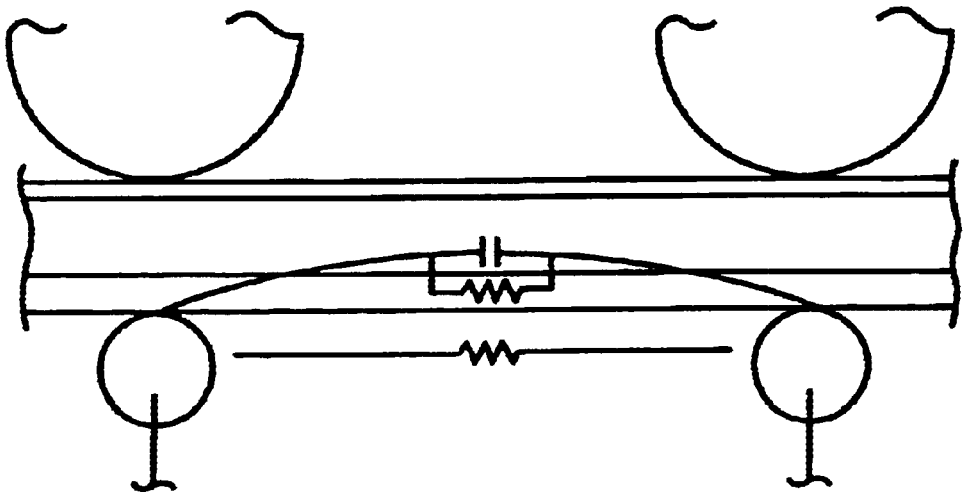
FIG. 13 is a view for describing a current to flow through the inner surface of the intermediate image transfer belt and derived from AC.

FIGS. 12 and 13 demonstrate how a current flows through the resistance of the inner surface of the intermediate belt 10 as to DC and AC, respectively. As shown in FIG. 12, in the case of DC, a current flows through the medium resistance layer of the inner surface of the intermediate belt 10, so that the sum of resistances on force lines constitute a DC resistance. As shown in FIG. 13, in the case of AC, the capacitance of the material is positioned in parallel to the force line portion, so that the total capacitance is not negligible. This characteristic value is dependent on the substantial thickness and capacity of the inner surface layer of the intermediate belt 10 and is expected to be stable if intermediate belts 10 are formed of the same material and formed in the same conditions.

More specifically, the resistance derived from the AC component having a frequency f is slightly lowered because capacity inside the belt film pressure exists in parallel to the above resistance. This relation, however, does not equally apply to all intermediate belts 10. FIG. 14 shows a specific table listing a correlation between AC resistance and DC resistance prepared in light of the above. With the table, it is possible to estimate the leak current Ileak of the DC component and then add the leak current Ileak to the set value of the DC component of the high-tension power supply section beforehand for thereby correcting the bias.

FIG. 15 shows an equation for determining the current to be assigned to each of the high-tension power supply sections 300 through 330. In the equation, IDC indicates a DC component while suffixes K, C, M and Y designate the power supply sections. The inner surface resistance Rb of the intermediate belt 10 is the cause of the leak of the primary image transfer current. Therefore, if the resistance Rb is known, the current value to be added to the power supply for image transfer is unconditionally determined. In FIG. 15, g denotes a conversion function used to determine a DC leak current on the basis of an AC current listed in FIG. 14. The conversion function g is representative of a conversion formula using a minute numerical table or a suitable table and interpolation. FIG. 14 shows resistances measured beforehand and derived from DC and AC. With this kind of scheme, it is possible to cope with the replacement of the material constituting the intermediate belt 10. When use is made of a non-polar ion-conductive material, the resistance Rb derived from AC is not noticeably different from the resistance Rb derived from DC. However, in the case of a polar material or a carbon-dispersed material, AC is presumably not negligible. It is to be noted that an increase in the inner surface resistance of the intermediate belt 10 first makes primary image transfer defective. It is therefore most important to measure the leak current when AC is connected.

The coupled AC component entered the load is subjected to current-to-voltage conversion. After the resulting voltage has been input to the buffer, the filter removes the frequency component of the power supply A. Subsequently, the detector converts the output of the filter to a DC voltage, which is representative of an AC current to leak from the power supply A to the outside. If a current to appear when the DC+AC component is caused to flow from the power supply A is measured beforehand, then there can be estimated a DC component to leak on the basis of the detected DC value. So long as the capacity of the intermediate belt 10 is large, the AC component is not transferred to the outer surface of the intermediate belt 10 and therefore does not effect image transfer. This can be easily done in the case of a laminate belt because such a belt originally has large capacity.

The scheme described above allows the DC component to rise and fall on a real-time basis and can therefore maintain the drum current constant during image formation. The frequency may or may not be fixed. The notch filter may be replaced with a filter having a more advanced function in order to promote accurate AC measurement by matching the AC component frequency.

The influence of the AC component on the nip between the drum 40 and the intermediate belt 40 decreases with an increase in the resistance of the belt 10, promoting easy handling of, e.g., a belt having a high outer surface resistance. This kind of intermediate belt 10 may have its outer surface implemented as a fluorine-contained high resistance layer.

Figure 16:
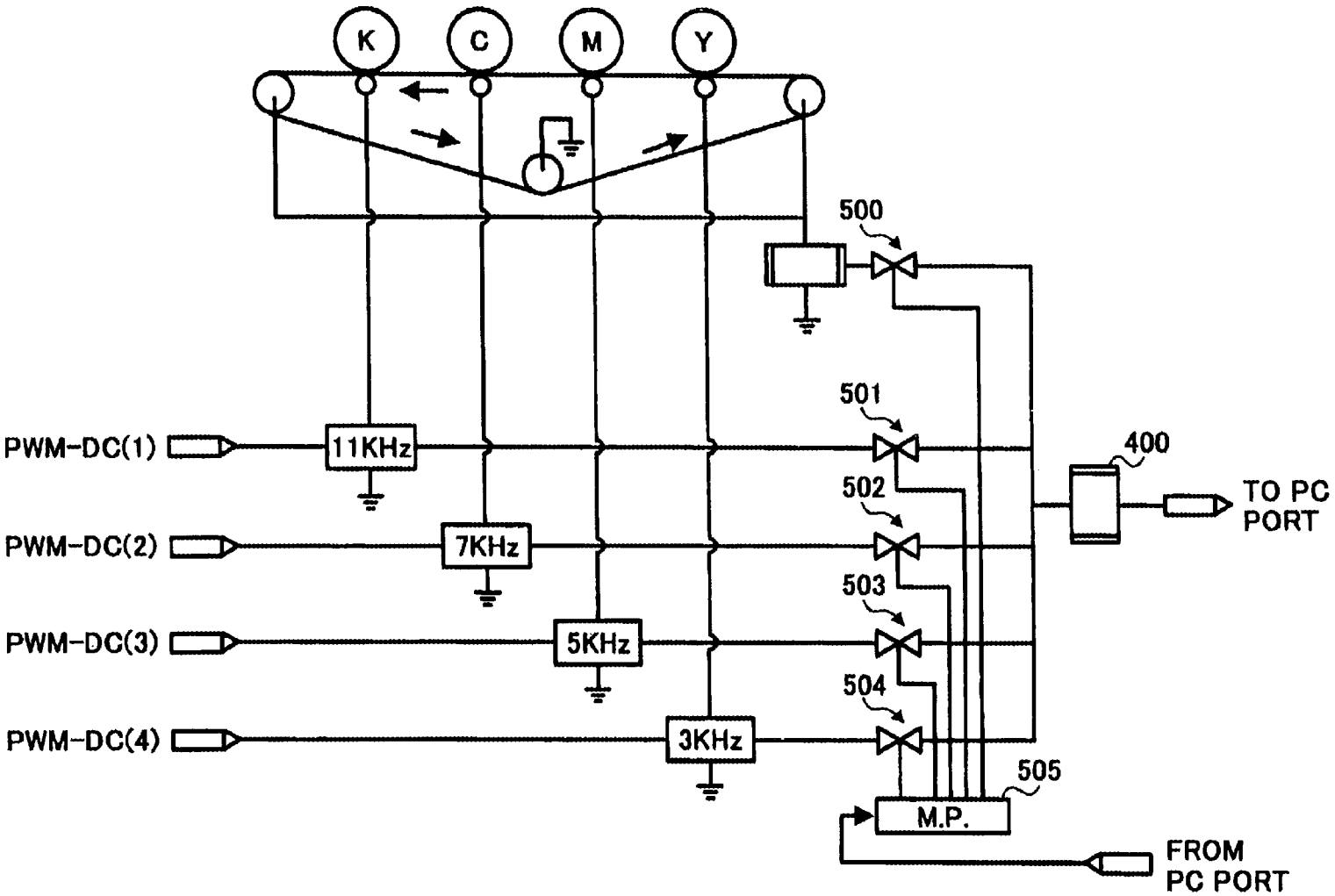
FIG. 16 shows an alternative embodiment of the present invention.

FIG. 16 shows an alternative embodiment of the present invention. As shown, the bias applying device includes analog switches 500, 501, 502, 503 and 504 and a multiplexer 505 that measures the outputs of the switches 500 through 504 by time division. The illustrative embodiment is therefore practicable with a single sensing section 400. In this case, the notch filter must be configured such that its variable control width fc is variable. A general-purpose filter with such a configuration is available on the market.

Figure 17:
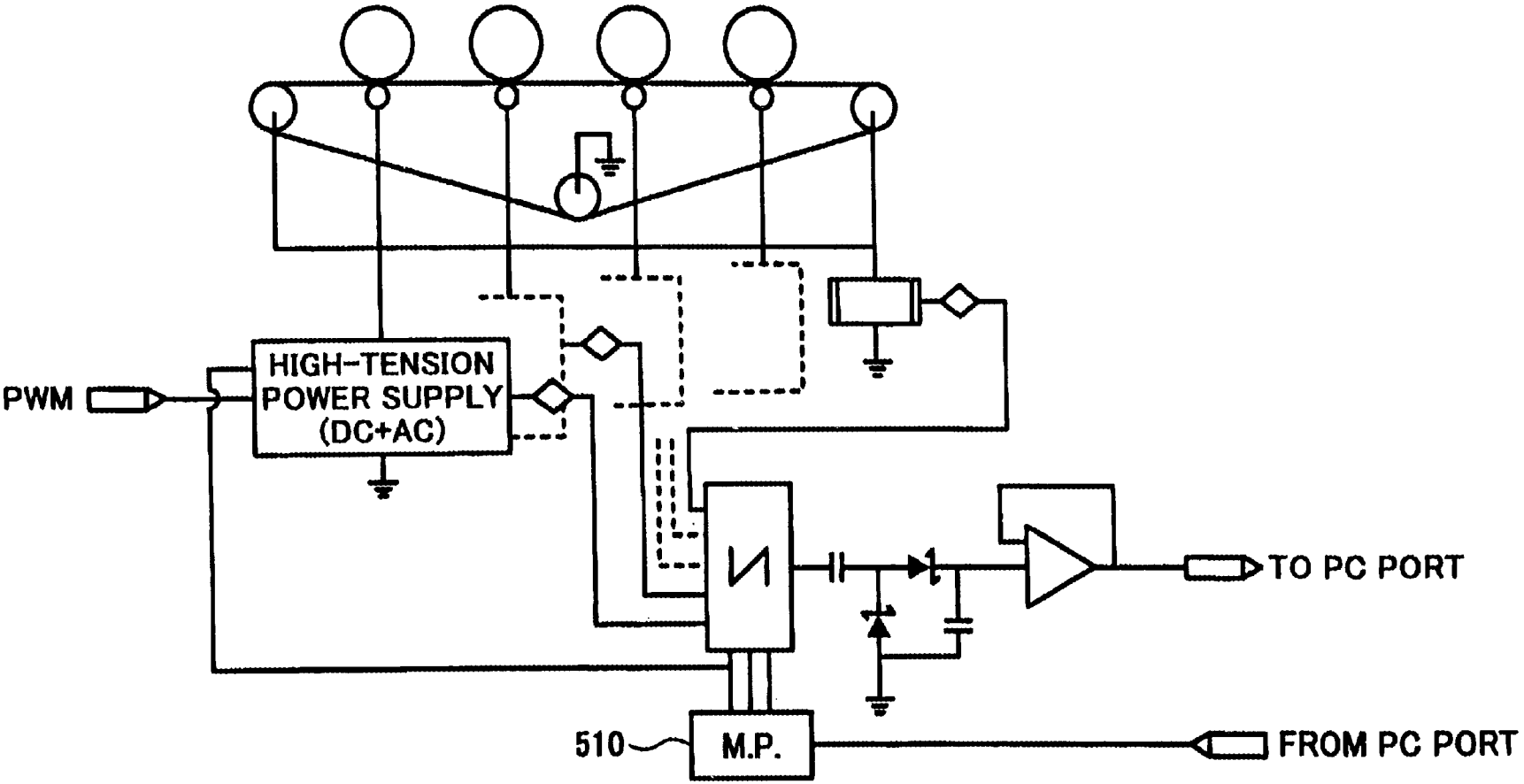
FIG. 17 shows another alternative embodiment of the present invention.

FIG. 17 shows another alternative embodiment of the present invention configured to reduce the number of parts by using time division. As shown, while the illustrative embodiment also includes the multiplexer 510, the multiplexer 510 is used to turn on and turn off the AC component of the high-tension power supply sections. Each sensing section does not include the band elimination filter.

Figure 18:
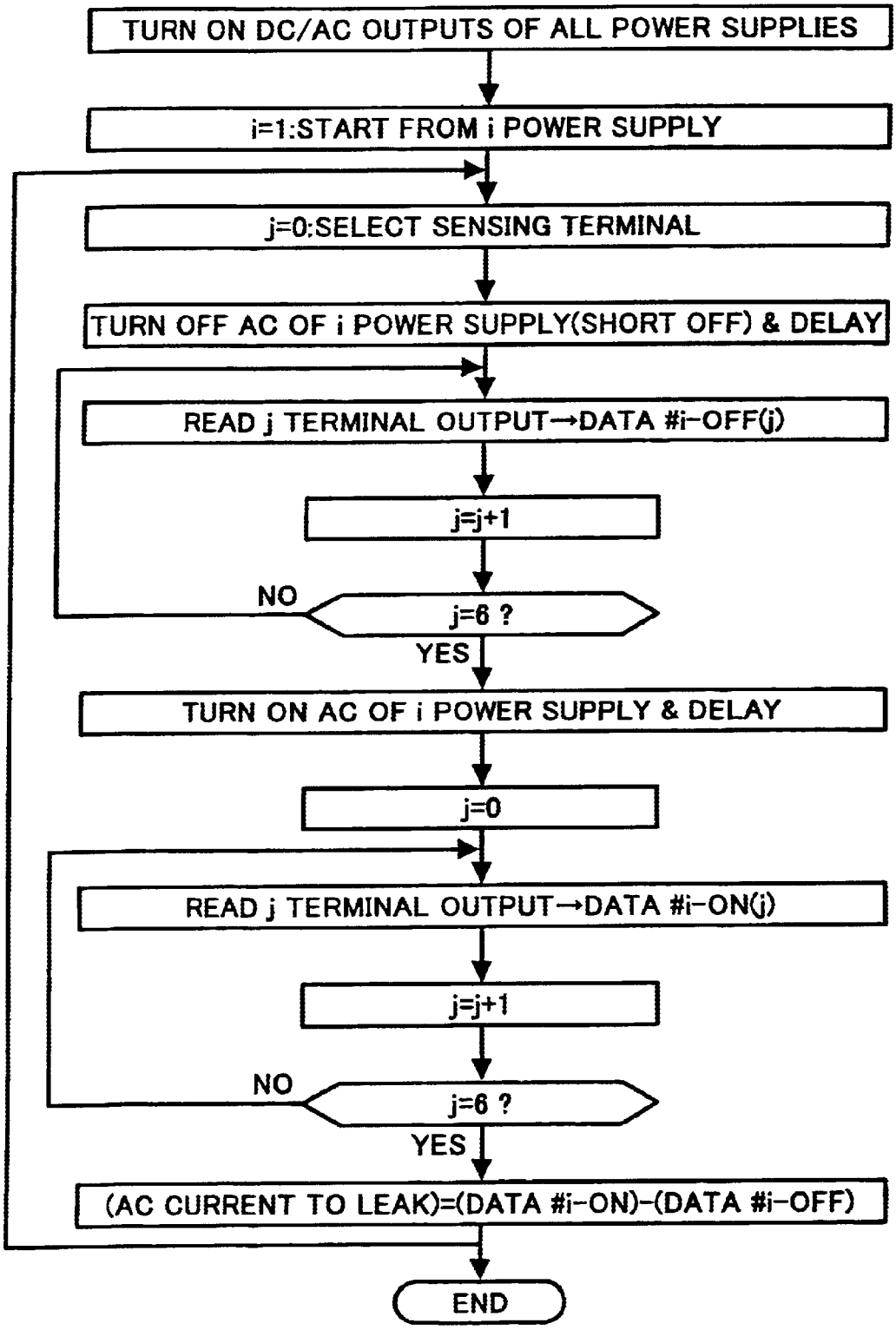
FIG. 18 is a flowchart demonstrating the operation of the embodiment shown in FIG. 17.

FIG. 18 demonstrates the operation of the embodiment shown in FIG. 17. As shown, measurement is conducted by turning off the AC component of only the necessary portion of a subject device and again turning on the AC component. This allows the AC leak current of each power supply to be measured and used to set a new DC current. Such a time division scheme generates a current even when an AC component is not attached to a major power supply and may cause the current to effect an image. However, if the duration of turn-off of the AC component is reduced or if the AC component is turned off in a non-image area, then an advantage is achievable as to belt resistance variation and charging although the real-time characteristic is slightly degraded.

In summary, in accordance with the present invention, it is possible to measure a current leaking between a plurality of high-tension power supply sections or to the ends thereof as AC resistances between respective terminals and therefore to accurately measure the leak currents of DC components. It follows that when relatively high DC components are selected, a difference in current between a plurality of power supply sections can be maintained constant.

Further, an adequate electric field for image transfer can be formed at each of a plurality of image transfer positions, insuring image formation free from defective image transfer.

Various modifications will become possible for those skilled in the art after receiving the teachings of the present disclosure without departing from the scope thereof.

What is claimed is:

1. In a bias applying device configured to form, at each of image transfer positions where a plurality of image carriers and an image transfer belt moving in contact with surfaces of said plurality of image carriers, an electric field for transferring a toner image formed on a respective image carrier to a transfer medium by applying a bias to said image transfer belt, said bias applying device comprising:

a plurality of bias applying means each for applying the bias to said image transfer belt at a respective image transfer position;

a plurality of high-potential power supply sections each being connected to one of said plurality of bias applying means for applying a bias, which consists of a DC component and a particular AC component superposed on said DC component, to respective bias applying means;

a plurality of sensing sections each being connected one of said plurality of bias applying means for sensing the AC component of the bias of respective bias applying means; and a central processing unit configured to control said plurality of high-tension power supply sections and said plurality of sensing sections;

a bias applying method for said bias applying device comprising the steps of:

detecting an AC component of a second high-tension power supply section, which is detected at an output of a first high-tension power supply section;

determining an AC resistance between said first high-tension power supply section and said second high-tension power supply section on the basis of an absolute value of the AC component detected;

estimating a leak current of a DC component by referencing a table listing a correlation between AC resistances and DC resistances and prepared beforehand; and adding the leak current to a set DC value assigned to said first high-tension power supply section to thereby correct the bias.

2. In a bias applying device configured to form, at each of image transfer positions where a plurality of image carriers and an image transfer belt moving in contact with surfaces of said plurality of image carriers, an electric field for transferring a toner image formed on a respective image carrier to a transfer medium by applying a bias to said image transfer belt, said bias applying device comprising:

a plurality of bias applying means each for applying the bias to said image transfer belt at a respective image transfer position;

a plurality of high-potential power supply sections each being connected to one of said plurality of bias applying means for applying a bias, which consists of a DC component and a particular AC component superposed on said DC component, to respective bias applying means;

a plurality of sensing sections each being connected one of said plurality of bias applying means for sensing the AC component of the bias of respective bias applying means; and a central processing unit configured to control said plurality of high-tension power supply sections and said plurality of sensing sections;

a bias applying method for said bias applying device comprising the steps of:

causing each of said high-tension power supply sections to apply a DC component on which alternating biases perpendicular to each other are superposed to particular bias applying means;

selectively detecting said alternating biases to thereby measure an absolute value;

calculating, based on said absolute value, a resistance between nodes;

estimating a coupling impedance corresponding to the resistance and a leak current to appear when the DC component is applied alone; and adding the leak current to an original target DC current to thereby correct the bias.

3. A bias applying device configured to form, at each of image transfer positions where a plurality of image carriers and an image transfer belt moving in contact with surfaces of said plurality of image carriers, an electric field for transferring a toner image formed on a respective image carrier to a transfer medium by applying a bias to said image transfer belt, said bias applying device comprising:

a plurality of bias applying means each for applying the bias to said image transfer belt at a respective image transfer position;

a plurality of high-potential power supply sections each being connected to one of said plurality of bias applying means for applying a bias, which consists of a DC component and a particular AC component superposed on said DC component, to respective bias applying means;

a plurality of sensing sections each being connected one of said plurality of bias applying means for sensing the AC component of the bias of respective bias applying means;

a central processing unit configured to control said plurality of high-tension power supply sections and said plurality of sensing sections; and bias correcting means configured to detect an AC component of a second high-tension power supply section, which is detected in the vicinity of an output of a first high-tension power supply section, determine an AC resistance between said first high-tension power supply section and said second high-tension power supply section on the basis of an absolute value of said AC component detected, estimate a leak current of a DC component by referencing a table listing a correlation between AC resistances and DC resistances and prepared beforehand, and add said leak current to a set DC value assigned to said first high-tension power supply section to thereby correct the bias.

4. The device as claimed in claim 3, wherein said high-tension power supply sections each comprise a constant current DC generating device capable of setting any DC component, and a constant voltage AC generating device capable of setting a frequency beforehand and capable of being ON/OFF controlled.

5. The device as claimed in claim 3, wherein said sensing sections each are connected to the output of the respective high-tension power supply section and reduces a frequency contained in an output of said respective high-tension power supply section with a notch filter and then detects said output to thereby output the absolute value of the AC component.

6. An image forming apparatus comprising:

a plurality of image forming means each comprising an image carrier for forming a latent image thereon, latent image forming means forming said latent image on said image carrier, developing means for developing said latent image to thereby produce a corresponding toner image, and image transferring means for transferring said toner image to a transfer medium, and an image transfer belt movable in contact with surfaces of image carriers of said plurality of image forming means;

said image transferring means comprising a bias applying means configured to form, at each of image transfer positions where a plurality of image carriers and an image transfer belt moving in contact with surfaces of said plurality of image carriers, an electric field for transferring a toner image formed on a respective image carrier to a transfer medium by applying a bias to said image transfer belt;

said bias applying device comprising:

a plurality of bias applying means each for applying the bias to said image transfer belt at a respective image transfer position;

a plurality of high-potential power supply sections each being connected to one of said plurality of bias applying means for applying a bias, which consists of a DC component and a particular AC component superposed on said DC component, to respective bias applying means;

a plurality of sensing sections each being connected one of said plurality of bias applying means for sensing the AC component of the bias of respective bias applying means;

a central processing unit configured to control said plurality of high-tension power supply sections and said plurality of sensing sections; and bias correcting means configured to detect an AC component of a second high-tension power supply section, which is detected in the vicinity of an output of a first high-tension power supply section, determine an AC resistance between said first high-tension power supply section and said second high-tension power supply section on the basis of an absolute value of said AC component detected, estimate a leak current of a DC component by referencing a table listing a correlation between AC resistances and DC resistances and prepared beforehand, and add said leak current to a set DC value assigned to said first high-tension power supply section to thereby correct the bias.

7. The apparatus as claimed in claim 6, wherein said high-tension power supply sections each comprise a constant current DC generating device capable of setting any DC component, and a constant voltage AC generating device capable of setting a frequency beforehand and capable of being ON/OFF controlled.

* * * * *